US011466439B1

(12) United States Patent
Kuo et al.

(10) Patent No.: US 11,466,439 B1
(45) Date of Patent: Oct. 11, 2022

(54) ADAPTOR FOR CONNECTING COVER TO OVERFLOW PIPE

(71) Applicants: BRIDGING PARTNERS CORPORATION, Taipei (TW); Chih-Wei Chen, Changhua (TW)

(72) Inventors: Kuang-Ming Kuo, New Taipei (TW); Chih-Wei Chen, Changhua (TW)

(73) Assignee: Bridging Partners Corporation, Taipei (TW)

( * ) Notice: Subject to any disclaimer, the term of this patent is extended or adjusted under 35 U.S.C. 154(b) by 0 days.

(21) Appl. No.: 17/341,768

(22) Filed: Jun. 8, 2021

(51) Int. Cl.
*E03C 1/244* (2006.01)

(52) U.S. Cl.
CPC ..... *E03C 1/244* (2013.01)

(58) Field of Classification Search
CPC . E03C 1/24; E03C 1/244; E03C 1/232; E03C 1/22
USPC ..... 4/695
See application file for complete search history.

(56) References Cited

U.S. PATENT DOCUMENTS 6,073,278 A * 6/2000 Ball ..... E03C 1/24 4/694
9,982,424 B1 * 5/2018 Kuo ..... E03C 1/24
10,513,841 B1 * 12/2019 Robillard ..... E03C 1/244
10,563,385 B1 * 2/2020 Ball ..... E03C 1/24
2013/0031720 A1 * 2/2013 Homami ..... E03C 1/244 4/694
2013/0081203 A1 * 4/2013 Filtness ..... E03C 1/24 4/674
2014/0259386 A1 * 9/2014 Antoniello ..... E03C 1/24 4/694
2017/0335554 A1 * 11/2017 Kuo ..... E03C 1/24
2017/0356174 A1 * 12/2017 Humber ..... E03C 1/244
2020/0256043 A1 * 8/2020 Mills ..... E03C 1/244
2021/0395985 A1 * 12/2021 Hsu ..... E03C 1/24

* cited by examiner

*Primary Examiner* — Benjamin R Shaw
(74) *Attorney, Agent, or Firm* — Rosenberg, Klein & Lee

(57) ABSTRACT

An adaptor for connecting a cover to an overflow pipe includes an H-shaped body which is installed in an end portion of the overflow pipe. The lengthwise length of the adaptor is not longer than the outer diameter of the end portion of the overflow pipe. The adaptor includes a first connection portion formed to the center of the adaptor, and two second connection portions respectively formed to two ends of the adaptor. Two lateral sides are formed to two sides of the adaptor. The cover includes a notch communicating with the end portion of the overflow pipe. Multiple protrusions extend from the inner bottom of the cover. The protrusions are engaged with the two lateral sides of the adaptor to connect the cover to the adaptor. Bolt(s) extend through first or second connection portions of the adaptor and are connected to the end section of the overflow pipe.

5 Claims, 5 Drawing Sheets

ADAPTOR FOR CONNECTING COVER TO OVERFLOW PIPE

BACKGROUND OF THE INVENTION

1. Fields of the Invention

The present invention relates to an overflow pipe of a bathtub, and more particularly, to an adaptor for connecting a cover to the overflow pipe of different structure.

2. Descriptions of Related Art

The conventional bathtub generally includes an overflow hole at a desired height of the bathtub so that when the water level reaches the overflow hole, the excessively flowing water will flow from the overflow hole. There is an overflow pipe directly connected to the bathtub and a cover is mounted to the distal end of the overflow pipe. The overflow pipe includes an L-shaped distal section which is horizontally installed. There are two different structure for the L-shaped distal section of the overflow pipe, the first one includes a single tube, and the second one includes two tubular portions. The cover is connected to the distal end of the overflow pipe by one or two bolts. The cover includes a notch which communicates with the overflow pipe.

The existed covers has one hole or two holes so as to be respectively connected to the overflow pipes of different structure. Because the position of the one hole and the positions of the two holes are different from each other, so that the covers are replaced by using the specific type of covers. In other words, the cost for stock is increased because more covers are required to meet the needs.

The present invention intends to provide an adaptor which is able to be connected to different types of the end sections of the overflow pipe to eliminate shortcomings mentioned above.

SUMMARY OF THE INVENTION

The present invention relates to an adaptor for connecting a cover to an overflow pipe, and the adaptor comprises an H-shaped body which is placed horizontally and installed in an end portion of the overflow pipe. The end portion is a tubular portion with an open end. The lengthwise length of the adaptor is not longer than an outer diameter of the end portion of the overflow pipe. The adaptor includes a first connection portion formed to the center of the adaptor, two second connection portions respectively formed to two ends of the adaptor, and two lateral sides formed to two sides of the adaptor. The cover includes a notch defined along the periphery thereof, and the notch communicates with the end portion of the overflow pipe. Multiple protrusions extend from the inner bottom of the cover. The protrusions are engaged with the two lateral sides of the adaptor so as to connect the cover to the adaptor.

The adaptor of the present invention is connected to the end portion of the overflow pipe of different structure, and the cover is hooked to the adaptor by the protrusions. Therefore, the cover is connected to the end portions of the overflow pipes of different structure.

The advantages of the present invention are that the adaptor can be connected to the end portion with on single tube or two tubular parts. The cover includes multiple protrusions to hook the adaptor so that the cover can be mounted to the end portions of overflow pipes of different structure. Therefore, the replacement of the cover is easy and saves cost.

The adaptor includes the first connection portion and the second connection portions to be connected with the end portions of the overflow pipes of different structure. The cover can easily hook the adaptor and to be mounted to the end portion of the overflow pipe.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
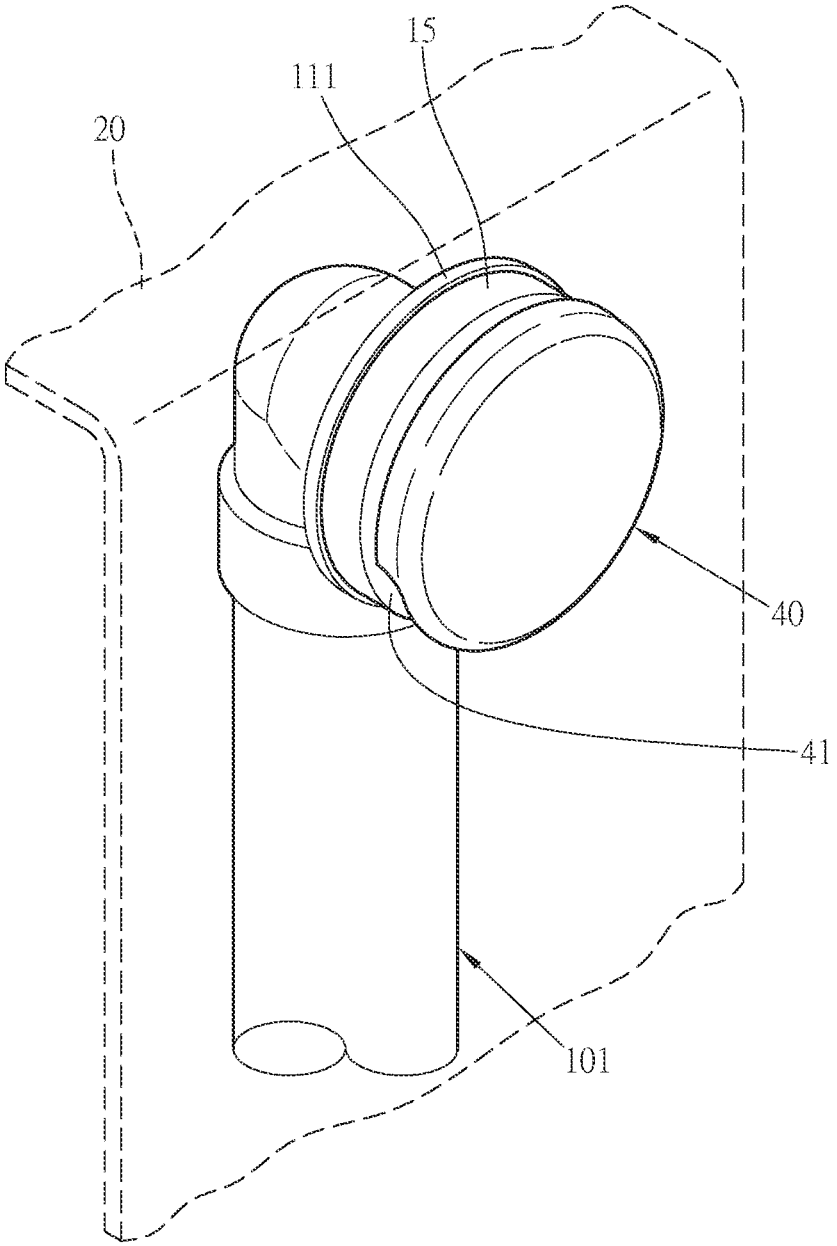
FIG. 1 is a perspective view to show a cover is mounted to the end portion of the overflow pipe.
Figure 2:
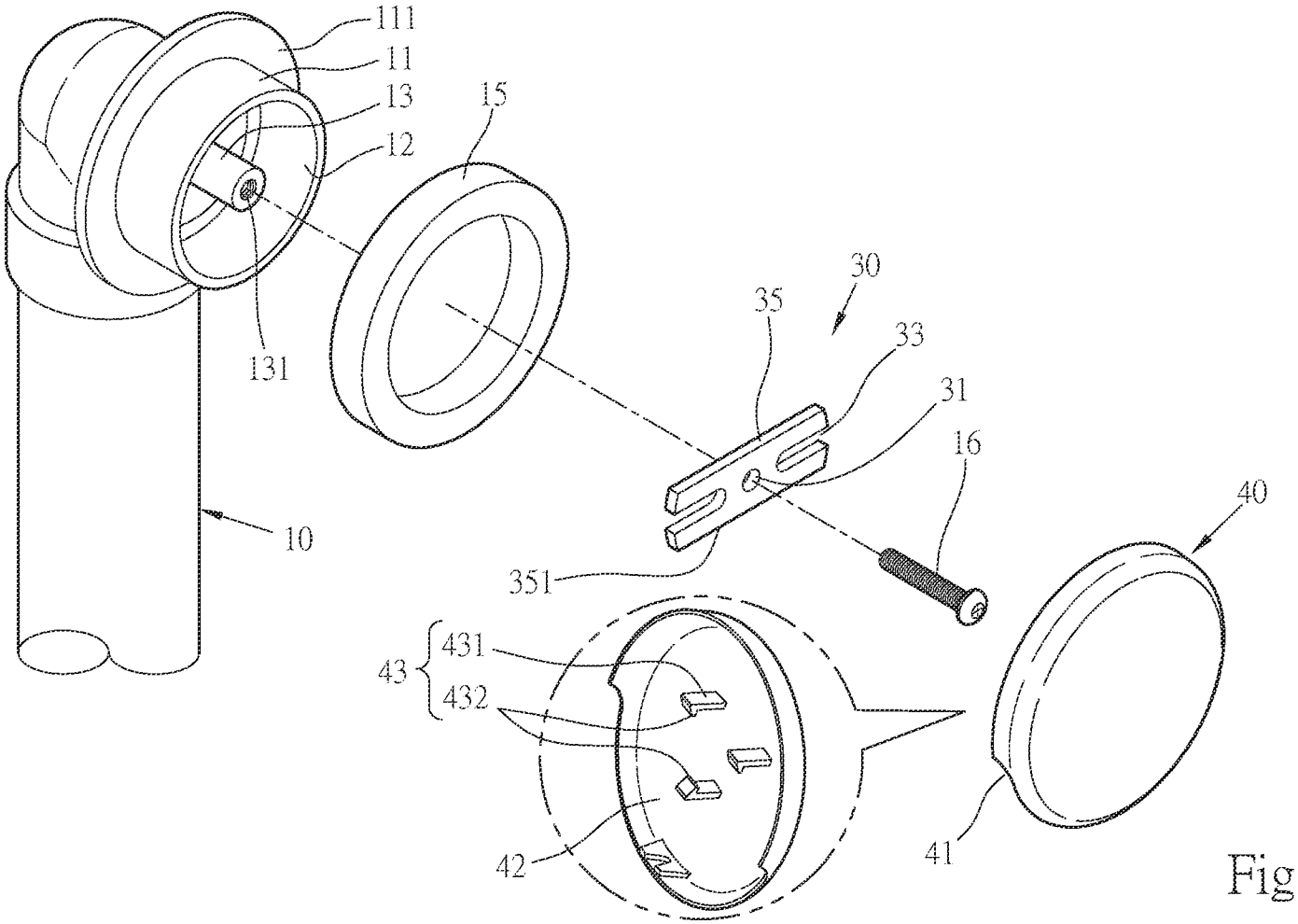
FIG. 2 is an exploded view of the adaptor of the present invention, the end portion with a tube, the cover and a seal ring.
Figure 3:
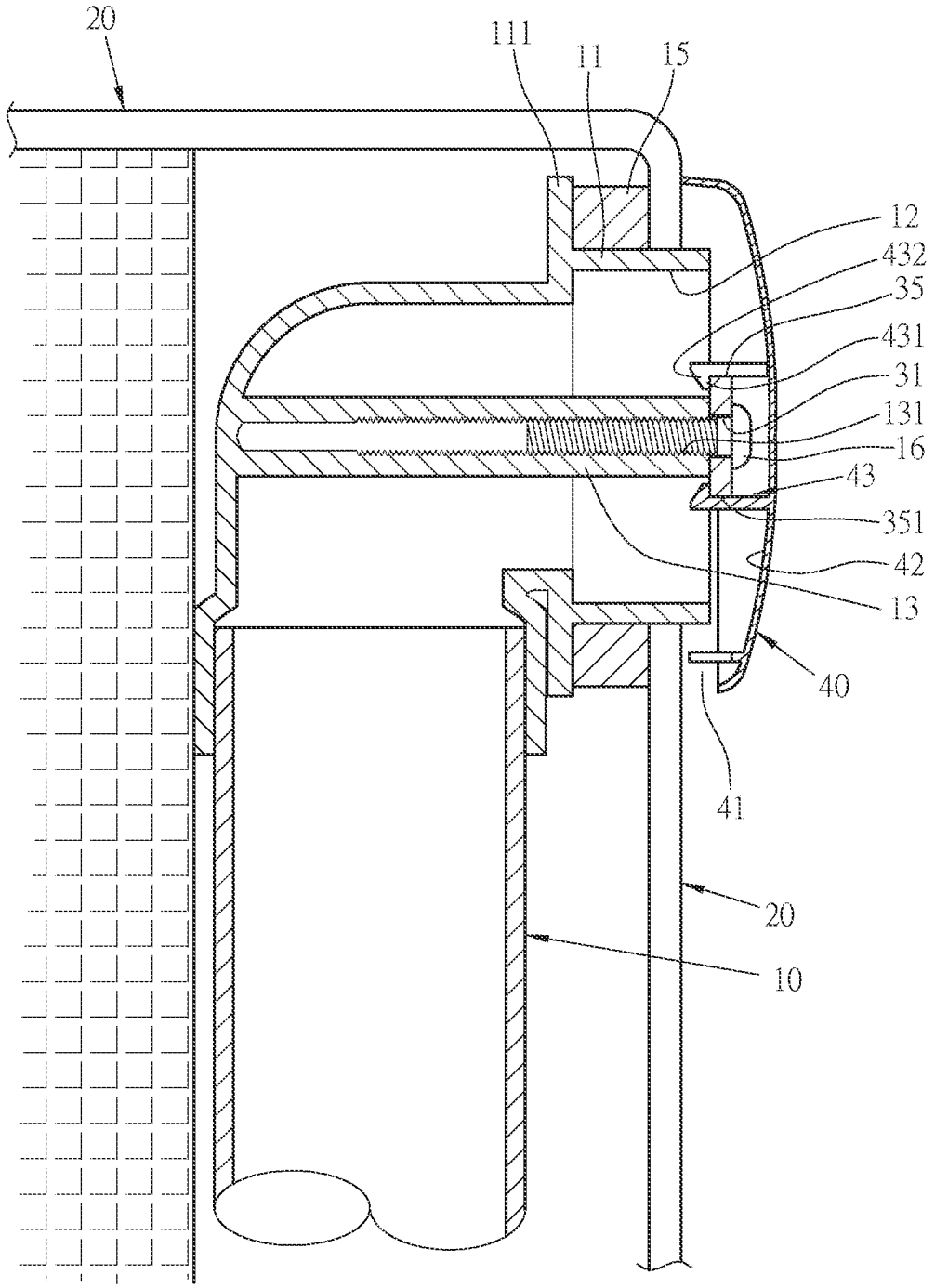
FIG. 3 is a side cross sectional view of show that the cover is mounted to the end portion with the tube by the adaptor of the present invention.

Referring to FIGS. 1 to 3, the adaptor 30 of the present invention comprises an H-shaped body which is placed horizontally and connected to an end portion 11 of the overflow pipe 10. The end portion 11 is a tubular portion with an open end, and the end portion 11 is bent relative to the overflow pipe 10. A flange 111 extends outward from the end portion 11. The end portion 11 includes a path 12 that communicates with the overflow pipe 10. The end portion 11 is installed to the bathtub 20 as shown in FIG. 3, wherein a seal ring 15 is clamped between the flange 111 and the inside of the bathtub 20. The end portion 11 extend beyond the bathtub 20 and is connected to a cover 40.

The lengthwise length of the adaptor 30 is not longer than the outer diameter of the end portion 11 of the overflow pipe 10 so that the adaptor 30 can be installed to the end portion 11. The adaptor 30 includes a first connection portion 31 formed to a center of the adaptor 30, two second connection portions 33 respectively formed to two ends of the adaptor 30, two lateral sides 35, 351 formed to two sides of the adaptor 30. In this embodiment, the first connection portion 31 is a hole and the two second connection portions 33 each are a slot which opens through one of the two ends of the adaptor 30, and the two lateral sides 35, 351 each are a straight side.

In this embodiment, a tube 13 is located along the axis of the end portion 11 of the overflow pipe 10, and a first threaded hole 131 is formed in the distal end of the tube 13. The first threaded hole 131 is located corresponding to the first connection portion 31 of the adaptor 30.

The cover 40 includes a notch 41 defined along the periphery thereof, and the notch 41 communicates with the end portion 11 of the overflow pipe 10, so that the exceed water may enters into the path 12 of the end portion 11 of the overflow pipe 10 via the notch 41. Multiple protrusions 43 extending from the inner bottom 42 of the cover 40.

Each of the protrusions 43 of the cover 40 includes a root 431 extending from the inner bottom 42 of the cover 40 and a hook 432 is formed to the distal end of the protrusion 43. The protrusions 43 are formed into two rows and are located corresponding to the two lateral sides 35, 351. The hooks 432 of the two rows of the protrusions 43 face each other. A bolt 16 extends through the first connection portion 31 of the adaptor 30 and is connected to the first threaded hole 131 of the tube 13 to secure the adaptor 30 to the end portion 11 of the overflow pipe 10. The hooks 432 of the protrusions 43 hook the two lateral sides 35, 351 to connect the cover 40 to the adaptor 30. The cover 40 is then mounted to the end portion 11, wherein the notch 41 is located at the lower position of the cover 40 to allow the exceed water to be drained via the overflow pipe 10.

Figure 4:
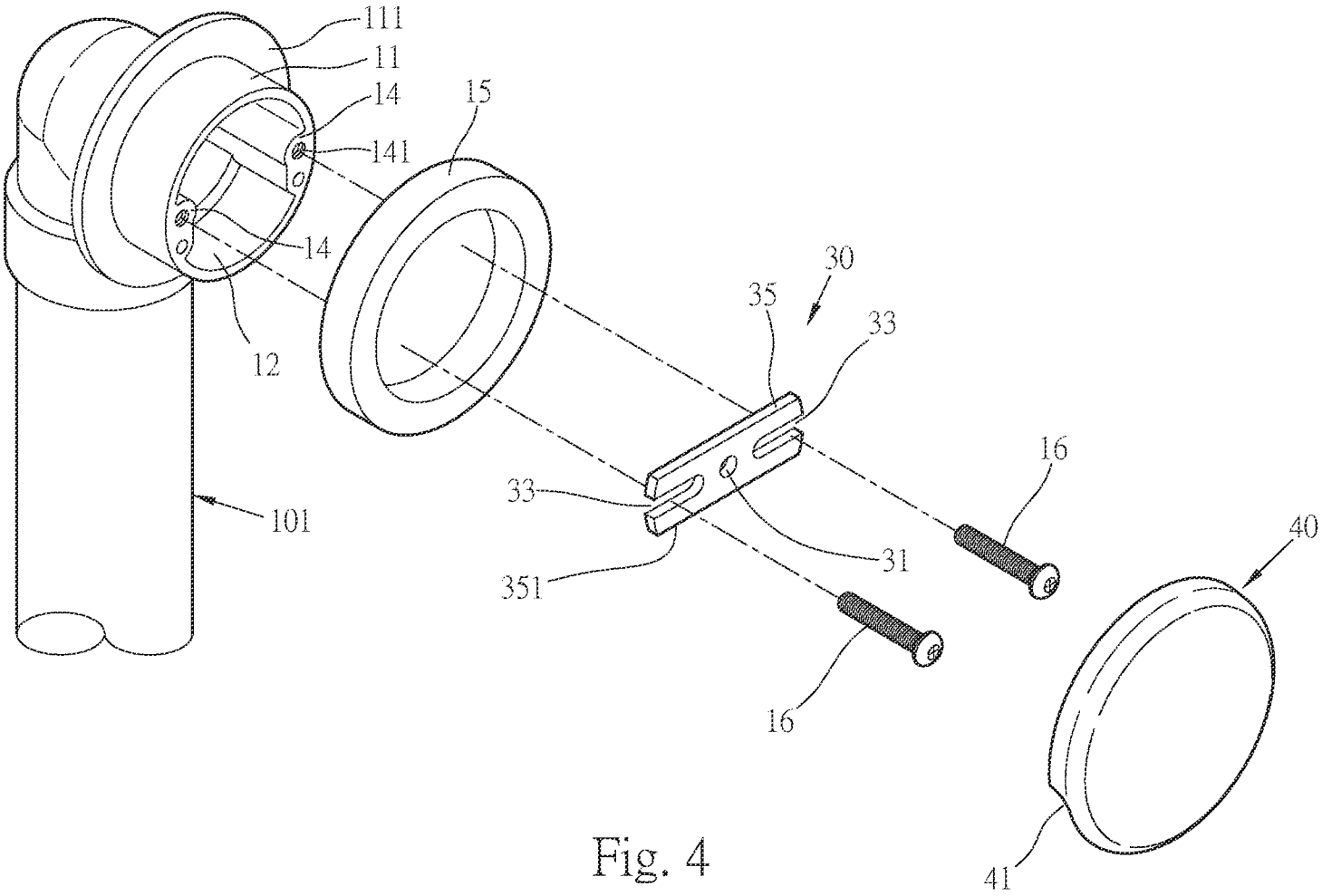
FIG. 4 is an exploded view of the adaptor of the present invention, the end portion with two tubular parts, the cover and a seal ring.
Figure 5:
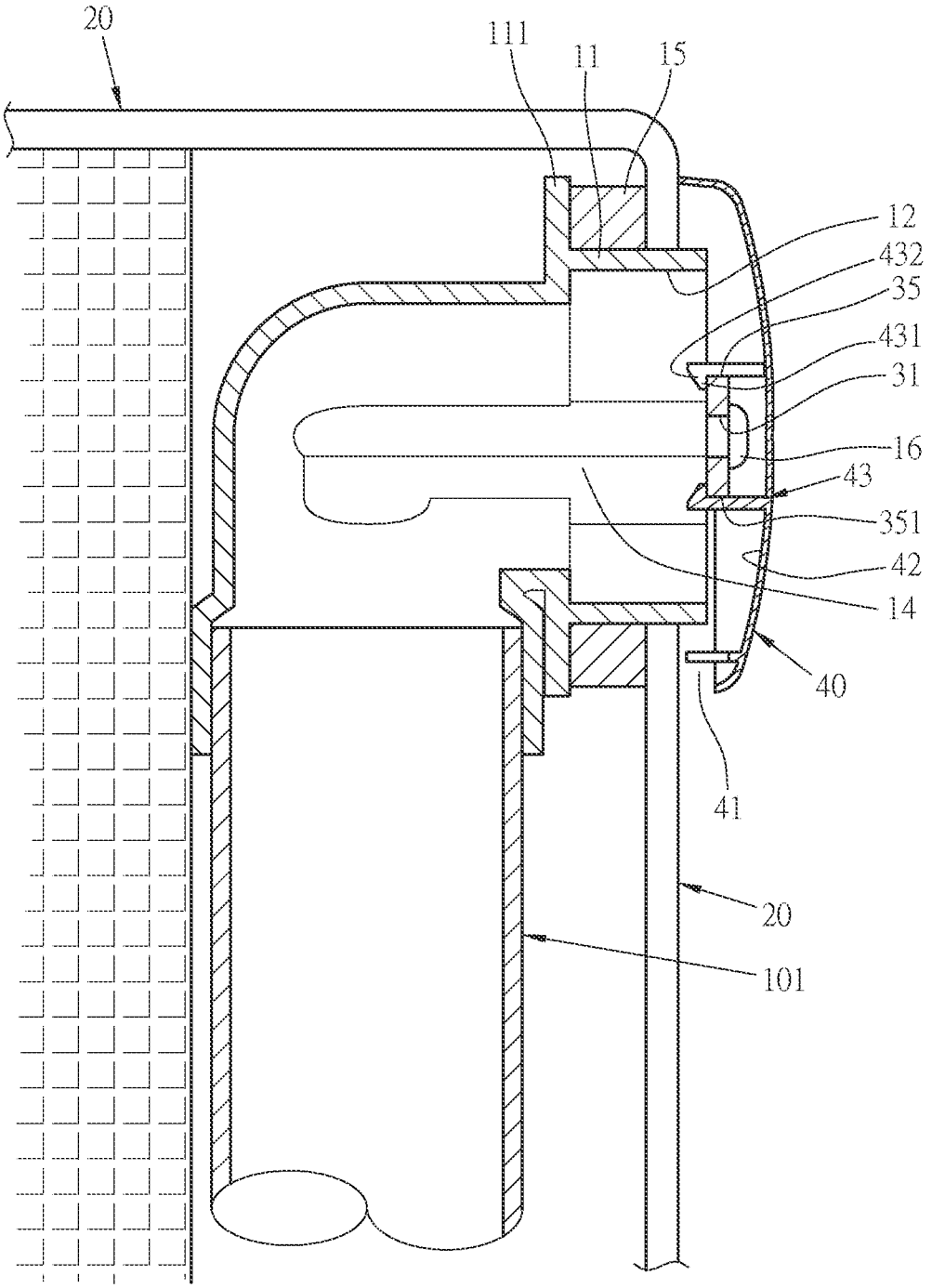
FIG. 5 is a side cross sectional view of show that the cover is mounted to the end portion with the two tubular parts by the adaptor of the present invention.

As shown in FIGS. 4 and 5, in this embodiment, two tubular part 14 are respectively formed to the n inner periphery of the end portion 11 of the overflow pipe 101. Each tubular part 14 includes a second threaded hole 141 formed to the distal end thereof. The two respective second threaded holes 141 are located corresponding to the two second connection portions 33 of the adaptor 30. When replacing the cover 40, two bolts 16 extend through the two second connection portions 33 of the adaptor 30 and are connected to the second threaded holes 141 to connect the adaptor 30 to the end portion 11. The cover 40, the same as the cover 40 used in the previous embodiment, is connected to the adaptor 30 by hooking the hooks 432 to the lateral sides 351 of the adaptor 30 so as to mount the cover 40 to the end portion 11.

The adaptor 30 of the present invention allows the same cover 40 to be used to the different end portions 11 of the two overflow pipes 10, 101. The installation of the adaptor 30 to the end portion 11 is easy, and the cover 40 is quickly connected to the adaptor 30.

While we have shown and described the embodiment in accordance with the present invention, it should be clear to those skilled in the art that further embodiments may be made without departing from the scope of the present invention.

What is claimed is:

1. An adaptor for connecting a cover to an overflow pipe, comprising:

an H-shaped body which is placed horizontally and connected to an end portion of the overflow pipe, the end portion being a tubular portion with an open end, a lengthwise length of the adaptor being not longer than an outer diameter of the end portion of the overflow pipe, the adaptor including a first connection portion formed to a center of the adaptor, two second connection portions respectively formed to two ends of the adaptor, two lateral sides formed to two sides of the adaptor, and the cover including a notch defined along a periphery thereof, the notch communicating with the end portion of the overflow pipe, multiple protrusions extending from an inner bottom of the cover, the protrusions engaged with the two lateral sides of the adaptor so as to connect the cover to the adaptor.

2. The adaptor as claimed in claim 1, wherein the first connection portion is a hole and the two second connection portions each are a slot which opens through one of the two ends of the adaptor, the two lateral sides each are a straight side.

3. The adaptor as claimed in claim 1, wherein each of the protrusions of the cover includes a root extending from the inner bottom of the cover, a hook is formed to a distal end of the protrusion, the protrusions are located corresponding to the two lateral sides, the hooks of the protrusions hook the two lateral sides.

4. The adaptor as claimed in claim 2, wherein a tube located along an axis of the end portion of the overflow pipe, a first threaded hole is formed in a distal end of the tube and located corresponding to the first connection portion of the adaptor, a bolt extends through the first connection portion of the adaptor and is connected to the first threaded hole of the tube.

5. The adaptor as claimed in claim 2, wherein two tubular part respectively formed to an inner periphery of the end portion of the overflow pipe, each tubular part includes a second threaded hole formed to a distal end thereof, the two respective second threaded holes are located corresponding to the two second connection portions of the adaptor, two bolts extend through the two second connection portions of the adaptor and are connected to the second threaded holes.

* * * * *